United States Patent [19]

Beal

[11] 4,266,299

[45] May 12, 1981

[54] PROTECTIVE GARMENT

[76] Inventor: Geraldine F. Beal, 55 Tillotson Rd., Needham, Mass. 02192

[21] Appl. No.: 61,492

[22] Filed: Jul. 27, 1979

[51] Int. Cl.[3] ..... A41D 27/12

[52] U.S. Cl. ..... 2/46; 2/51; 2/79; 2/227; 2/DIG. 6

[58] Field of Search ..... 2/46, 48, 51, 50, 227, 2/79, 228, DIG. 6

[56] References Cited

U.S. PATENT DOCUMENTS

| | | | |
|---|---|---|---|
| 1,018,078 | 2/1912 | Potter | 2/51 |
| 2,766,454 | 10/1956 | Rice | 2/48 |
| 3,774,240 | 11/1973 | Johnson | 2/51 |
| 4,014,045 | 3/1977 | Moyer | 2/51 |

FOREIGN PATENT DOCUMENTS

| | | | |
|---|---|---|---|
| 270981 | 5/1927 | United Kingdom | 2/50 |

*Primary Examiner*—H. Hampton Hunter

[57] ABSTRACT

A protective garment comprising an upper portion adapted to cover the chest and back of a wearer, and a lower portion comprising first and second extensions adapted to cover a wearer's legs, the upper portion and leg extensions being adapted to be fastened about the wearer quickly and easily over the regular clothes of the wearer.

3 Claims, 1 Drawing Figure

PROTECTIVE GARMENT

BACKGROUND OF THE INVENTION

1. Field of the Invention

This invention relates to garments and is directed more particularly to protective garments for wear over the regular clothes of a wearer.

2. Discussion of the Prior Art

Protective garments are generally known in the art and serve to fit over the regular clothes of a wearer and protect the regular clothes from the consequences of a task resulting in dirtying of the clothes of the wearer. One such task, for example, is that of loading and/or unloading trucks at a platform.

Garments adapted to be worn over other garments are generally known. For example, in U.S. Pat. No. 1,018,078, issued Feb. 20, 1912 to F. O. Potter, there is shown a mechanics apron including an apron portion and leg portions, with fastening means to facilitate fastening about a wearer in the neck, waist and ankle areas. In U.S. Pat. No. 1,596,085, issued Aug. 17, 1926 to E. Downes, there is shown an overcoat having leg portions which are adapted to fit about the legs of a wearer.

A need exists for a protective garment which may be easily and quickly slipped over the clothes of a loading dock worker, will serve to protect the worker's clothes, particularly the front surfaces thereof, and be easily removed by the worker at the completion of the job. It is further desirable that the garment, though providing protection to the wearer, be as "open" and cool as possible.

SUMMARY OF THE INVENTION

It is therefore an object of the invention to provide a protective garment which may be easily and quickly slipped on and off a wearer.

A further object of the invention is to provide such a garment as will afford complete protection for the clothes of the wearer while performing loading dock and similar operations.

A still further object of the invention is to provide such a garment having as much openess as possible to permit free circulation of air about the body of the wearer, and ease of movement.

Still another object of the invention is to provide such a garment as is relatively simple and inexpensive to make and of durable and sturdy construction.

With the above and other objects in view, as will hereinafter appear, a feature of the present invention is the provision of a protective garment comprising an upper portion having an opening therein adapted to fit about the neck of a wearer, the upper portion comprising a front panel adapted to lie against the chest of the wearer, and a back panel adapted to extend generally coextensive with the back of the wearer, the front and back panels having first connecting means disposed at the waist of the wearer for releasable interconnection of the front and back panels, and a lower portion connected to the upper portion, the lower portion comprising first and second leg extensions, each of the extensions being generally rectangularly-shaped and having at its end remote from the upper portion flap means adapted to encircle a knee portion of the wearer, and second connecting means disposed on the flap means, whereby the extensions may be fastened about knee portions of the wearer.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWING

Reference is made to the accompanying drawing in which is shown an illustrative embodiment of the invention from which its novel features and advantages will be apparent.

In the drawing.

DESCRIPTION OF THE PREFERRED EMBODIMENT

Figure 1:
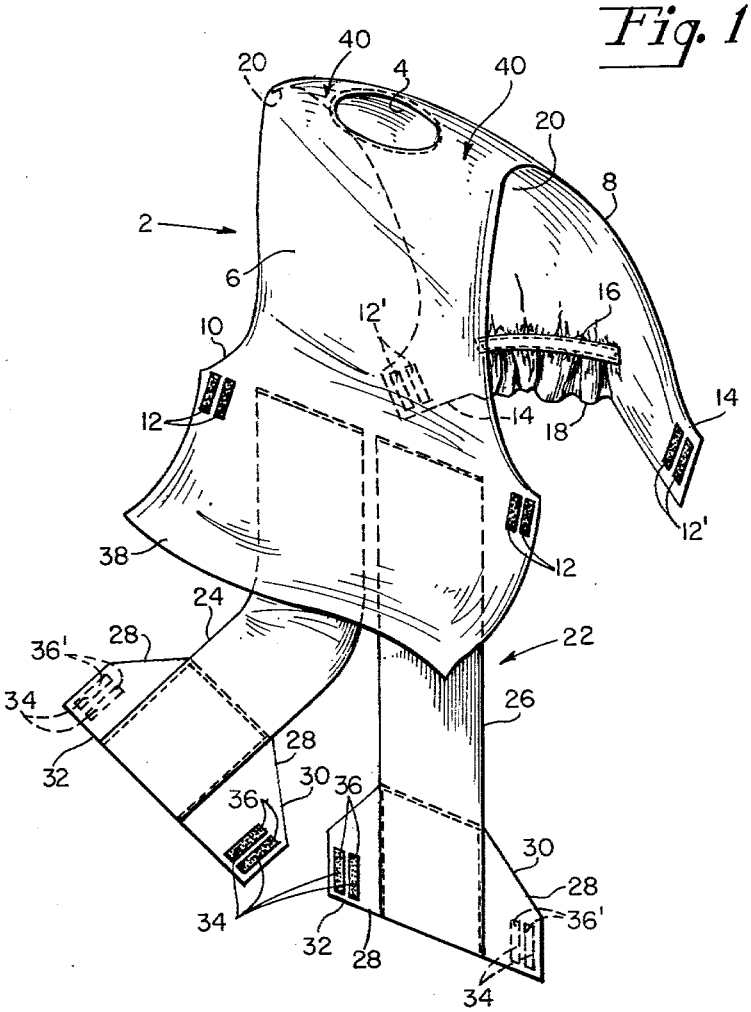
FIG. 1 is a perspective view of one form of protective garment illustrative of an embodiment of the invention.

Referring to the drawing, it will be seen that the illustrative embodiment includes an upper portion 2 having an opening 4 therein. The opening 4 is adapted to be moved over the head of a wearer and to fit about the wearer's neck. The upper portion 2 of the garment includes a front panel 6 which is adapted to be coextensive with and lie against the chest of the wearer. The upper portion 2 further includes a back panel 8 adapted to be coextensive with and lie against the back of the wearer. The front panel 6 is provided with a pair of tabs 10 extending from either side thereof and having front connecting means 12 fixed thereto. The back panel 8 is provided with a pair of tabs 14 extending from either side thereof and having back connecting means 12' fixed thereto. The front and back connecting means 12, 12' are releasably interconnectable at the waist of the wearer to releasably attach the front panel to the back panel at the wearer's waist.

Preferably, the connecting means 12, 12' are of hermaphroditic material, such as that sold under the trademark VELCRO, and comprise a plurality of strips of such material to facilitate sizing by the wearer. While hermaphroditic material is preferred, it will be apparent that a selection of snap-fittings or the like, would serve the purpose.

The upper portion back panel 8 is preferably provided with an elasticized band 16 extending width-wise thereof, the band being proximate a free end 18 of the back panel, near the waist of the wearer.

Upon fastening together of the front and back panels 6, 8 by the connecting means 12, 12', there will thereby be formed arm openings 20 for the arms of the wearer.

Connected to the upper portion 2 of the garment is a lower portion 22 having first and second leg extensions 24, 26. Each of the extensions 24, 26 is generally rectangularly-shaped and has at its free end flap means 28 adapted to encircle a knee of the wearer to keep the leg extension in place. Preferably, the flap means comprises first and second flaps 30, 32 extending from either side of each leg extension and having second connecting means 34 thereon, for fastening the flaps 30, 32 together about the wearer's knees. The second connecting means may be similar to the first connecting means 12, 12' and preferably includes interconnectable hermaphroditic strips 36, 36', arranged to afford a sizing facility.

There may be attached to the upper portion 2 an apron 38. The apron may be detachably connected to the upper portion or may, as illustrated, be a permanent portion of the garment.

In use, a wearer places his head in the opening 4, a juncture 40 of the front and back panels 6, 8 coming to rest on the wearer's shoulders. The tabs 10, 14 are brought together to interconnect the first connecting means 12, 12' and thereby form the arm openings 20. The wearer then wraps the flaps 30, 32 around his knees, interconnecting the second connecting means 34. The wearer is well protected from the grime of shipping cartons, and the like, which otherwise might be ground into the front portions of his clothes. Yet, being substantially open in the back and sides, the garment permits ready circulation of air about the body of the wearer and facilitates ease of movement.

Upon completion of a working operation, the wearer need only pull apart the connecting means 12, 12' and 34 and move the garment over his head. Thus, the garment is quickly and easily put on and taken off. Further, the garment, though of durable construction, is susceptible to relatively simple and inexpensive manufacture.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A protective garment comprising an upper portion, said upper portion having an opening therein adapted to fit about the neck of a wearer, said upper portion comprising a front panel adapted to extend generally coextensive with the chest of said wearer, front panel tab portions extending from each side of said front panel and adapted to overlie the sides of said wearer, a back panel adapted to extend generally coextensive with the back of said wearer, and back panel tab portions extending from each side of said back panel and adapted to overlie said sides of said wearer, said front and back panel tab portions having first connecting means disposed at the waist of said wearer for releasable interconnection of said front and back panels, an apron depending from said front panel and said front panel tab portions throughout the length of said front panel tab portions, and a lower portion connected to an undersurface of said front panel, said front panel and said apron overlying said lower portion, said lower portion comprising first and second leg extensions, each of said extensions being generally rectangularly-shaped and having at its end remote from said upper portion flap means adapted to encircle a leg portion of said wearer, and second connecting means disposed on said flap means, whereby said extensions may be fastened about the leg portions of said wearer.

2. The invention in accordance with claim 1 in which said first connecting means comprises front connecting means fixed on said front panel tab portions and complementary back connecting means fixed on said back panel tab portions, said front and back connecting means being releasably interconnectable to releasably fasten said front and back panels together at said waist of said wearer.

3. The invention in accordance with claim 2 in which said back panel, said back panel tab portions, said front panel, said front panel tab portions, and said apron comprise a unitary member.

* * * * *